United States Patent [19]

Rich

[11] Patent Number: 5,052,285

[45] Date of Patent: Oct. 1, 1991

[54] AIR DIFFUSER FOR VENTILATING APPARATUS

[75] Inventor: Donald G. Rich, Fayetteville, N.Y.

[73] Assignee: Carrier Corporation, Syracuse, N.Y.

[21] Appl. No.: 534,395

[22] Filed: Jun. 7, 1990

[51] Int. Cl.[5] ..... F24F 13/06; F24F 7/00

[52] U.S. Cl. ..... 98/40.14; 98/40.15; 98/40.18

[58] Field of Search ..... 98/40.05, 40.14, 40.15, 98/40.18, 42.07, 40.01

[56] References Cited

U.S. PATENT DOCUMENTS

| | | | |
|---|---|---|---|
| 915,178 | 3/1909 | Hillyard | 98/40.01 |
| 2,504,472 | 4/1950 | Van Alsburg et al. | 98/40.15 |
| 2,576,905 | 11/1951 | Labus | 98/40.01 |
| 2,902,291 | 9/1959 | Peterson | 98/40.05 |
| 3,985,068 | 10/1976 | Herb | 98/40.14 |
| 4,276,818 | 7/1981 | Makara et al. | 98/40.15 |
| 4,815,531 | 3/1989 | Presz, Jr. et al. | 165/151 |

FOREIGN PATENT DOCUMENTS

| | | | |
|---|---|---|---|
| 3343731 | 6/1984 | Fed. Rep. of Germany | 98/40.18 |
| 1112050 | 3/1956 | France | 98/40.05 |
| 1281834 | 1/1987 | U.S.S.R. | 98/40.14 |
| 1312341 | 5/1987 | U.S.S.R. | 98/40.01 |
| 1312343 | 5/1987 | U.S.S.R. | 98/40.01 |

*Primary Examiner*—Albert J. Makay
*Assistant Examiner*—William C. Doerrler

[57] ABSTRACT

At least one wall of an air diffuser for a ventilating system is provided with a waved shape geometry defined by a plurality of troughs and lobes which are configured to receive a flow of conditioned air thereupon and to generate a plurality of vortices of conditioned air passing therefrom. The vortices of conditioned air induce a flow of ambient air from the other side of the wall to produce a mixing flow field of conditioned air and ambient air downstream of the outlet.

7 Claims, 3 Drawing Sheets

AIR DIFFUSER FOR VENTILATING APPARATUS

BACKGROUND OF THE INVENTION

1. Field of the Invention

This invention relates generally to ventilating apparatus, and has particular reference to air diffuser devices through which supply air for heating, cooling, ventilating or other purposes, is delivered into rooms or other enclosures.

2. Description of the Prior Art

Conditioned air, comprising either heated, cooled, dehumidified, humidified, or mixtures thereof is distributed into enclosed spaces within a building by means of appropriate ducts leading into appropriate ceiling, wall, or floor outlets. Numerous types of diffusers are known, some provided with louvers that may be individually adjustable, for attempting to provide effective distribution of the conditioned air according to the particular conditions prevalent in the enclosed spaces.

A particular disadvantage of the types of air diffusers heretofore available is that they are generally incapable of providing uniform distribution of conditioned air through the enclosed space, without creating drafts and uneven distribution for the conditioned air. Particularly with respect to cooled conditioned air, uncomfortable drafts of cold air are prevalent in some areas of the enclosed space, while other areas remain uncomfortably warm.

One approach to remedying this problem has been air diffusers which are said to promote mixing of the conditioned air with the ambient air within the room being cooled. Such diffusers, typically, will separate the flow of cooled air into a plurality of separate jets or streams. Such separate jets or streams are achieved by a variety of flow control devices, including deflectors, baffles, and other flow deflecting structures such as channels or the like. A common characteristic of such jets or streams is that they are substantially linear in nature.

One such device is shown in U.S. Pat. No. 2,825,274, "Air Outlet Device For Ventilating Apparatus". This patent discloses a device which is disposed transversely across the path of flow of conditioned air and which divides the supply air into separate laterally spaced apart streams. The '274 patent further states "As the supply air streams flow into the enclosure, they expand and diffuse and create more or less turbulence with the result that there occurs a more or less thorough mixing of the entrained enclosure air with the supply air in the immediate vicinity of the apparatus." Turbulent flow is not the most effective means of providing mixing.

U.S. Pat. No. 4,080,882, "Air Diffuser For Ceiling Air Outlet", discloses an air diffuser including among other things a plurality of V-shaped exit openings which compress and accelerate supply air which is being directed to the conditioned space. Another patent representative of the prior art is U.S. Pat. No. 4,679,495, "Air Diffuser". The '495 patent discloses a diffuser which has a plurality of nozzles separating the flow of air from the outlet to the ambient into a plurality of diverging air jet streams, with the result that air flowing from the outlet is "diffused and substantially uniformly distributed throughout an enclosure".

As pointed out above, the jets, or streams of supply air delivered by each of the above-noted prior art patents are separate, linear, streams of air which have a minimal effect on promoting mixing, either with one another or with ambient room air downstream from the diffuser outlets.

Another drawback of prior art air outlets for ventilation apparatus is found in devices where the air outlet is located adjacent the exposed surface of a ceiling or wall and which acts to effect more or less lateral deflection of the delivered air across the surrounding ceiling or wall area. The air delivered from such a device commonly picks up dust particles from the air contained in the room or other enclosure into which it is delivered. The flow of air from the air outlet device across the surrounding ceiling or wall area usually produces, with time, on this surrounding area, an unsightly deposit of dust, or smudge commonly referred to as a ceiling stain. Ceiling stains are generally most pronounced adjacent to the air outlet device and gradually diminish outwardly therefrom. The primary reason that the ceiling stains are most pronounced in the region surrounding the air outlets is that flow separation and recirculation results in a region of stagnation downstream from the air outlets. The stagnation zone is a direct result of the substantially linear nature of the flow in this region produced by such air outlet devices.

SUMMARY OF THE INVENTION

It is an object of the present invention to produce a mixing flow field downstream of the outlet of an air diffuser for a ventilating system which comprises a plurality of vortices of conditioned air intertwined with induced vortices of ambient air.

It is another object of this invention to produce a flow field downstream of the outlet of a ceiling diffuser which comprises a plurality of vortices of conditioned air which will provide a scrubbing air flow of the ceiling adjacent the diffuser outlet.

These and other objects of the present invention are achieved by an air diffuser adapted to receive a bulk flow of conditioned air at an upstream end thereof and for directing the air from the downstream end thereof into a conditioned space. The air diffuser includes a pair of spaced parallel walls which cooperate with one another to form an air discharge slot. At least one of the walls of the air discharge slot has a first side which is in fluid flow contact with the conditioned air and the second side thereof is in fluid flow contact with the ambient air in the space to be conditioned. The one wall of the slot has an exposed downstream edge configured such that conditioned air and ambient air flowing, respectively, over the first and second sides of the wall will mix together in the conditioned space downstream from the edge. The wall includes a plurality of adjoining alternating lobes and troughs. Each lobe and trough extends in the downstream direction to the downstream edge. The troughs increase in depth in the downstream direction from a minimum at the troughs upstream ends. Each lobe on one side of the wall has a corresponding trough opposite to it on the other side of the wall such that the wall and the downstream edge are wave-shaped. The contour and dimensions of the troughs and lobes are selected so that they cooperate to direct the bulk flow of conditioned air on the first side of the wall into a plurality of fluid streams. Each of the fluid streams originates at the upstream end of one of the troughs and gradually passes into that trough wherein the flow of conditioned air therein develops a vortex flow of conditioned air which extends downstream of the downstream edge of the wall. Each of the vortices of conditioned air extends from a trough on the one side of the wall and induces a secondary vortex flow from the adjacent troughs on the other side of the wall within the conditioned space. As a result, a mixing flow field, downstream of the downstream edge of the wall is produced which comprises a plurality of vortices of conditioned air intertwined with induced vortices of ambient air drawn through the troughs on the second side of the wall.

BRIEF DESCRIPTION OF THE DRAWINGS

The novel features which are considered characteristic of the invention are set forth with particularity in the appended claims. The invention itself, however, both as to its organization and its method of operation, together with additional objects and advantages thereof, will best be understood from the following description of the preferred embodiments when read in connection with the accompanying drawings wherein like numbers have been employed in the drawing figures to denote the same parts, and wherein;

DESCRIPTION OF THE PREFERRED EMBODIMENTS

To help understand the present invention reference will first be made to an air conditioning apparatus terminal according to the prior art as described first in FIGS. 1 and 2. Following that, the fluid flow enhancing surface shown in FIG. 3 will be described in connection with the teachings of U.S. Pat. No. 4,815,531, "Heat Transfer Enhancing Device".

Figure 1:
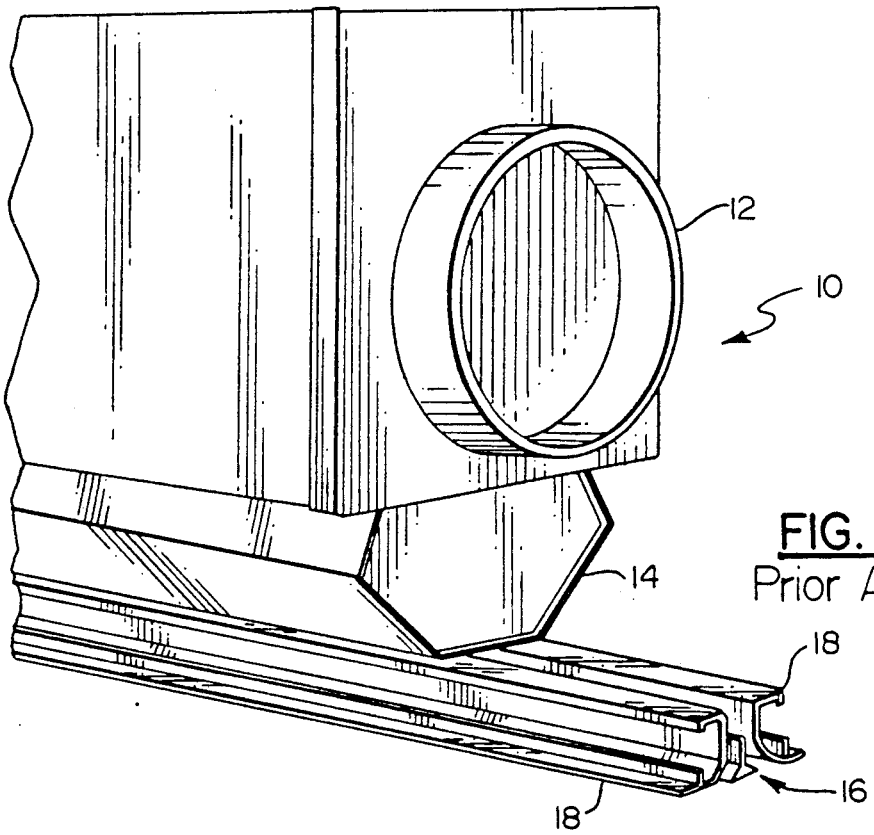
FIG. 1 Prior Art
FIG. 1 is a perspective view of a portion of an air conditioning system for use with the present invention illustrating an air terminal according to the prior art.

In FIG. 1, the numeral 10 generally designates an air terminal adapted to be mounted in a ceiling and which receives conditioned air via a supply duct 12. The supply duct 12 is illustrative of the plurality of ducts provided to supply conditioned air to ceiling air terminals throughout a building. Conditioned air from the supply duct 12 is directed to a distribution chamber 14 and from there downwardly to a longitudinally extending air discharge slot 16. The slot 16 is defined by a pair of longitudinally extending channels 18, each having an outwardly flared lower portion 20. As shown in FIG. 2, the upper surface of each of the lower portions 20 is provided with a stop member 22 which engages an edge portion of a ceiling 24 in which the diffuser terminal is adapted to be installed.

Figure 2:
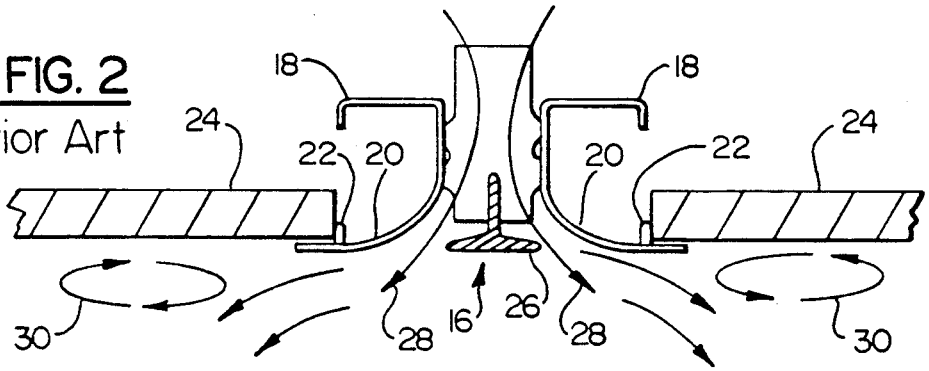
FIG. 2 Prior Art
FIG. 2 is an enlarged sectional view of the prior art terminal of FIG. 1.

A diffuser triangle 26 is supported within the discharge slot 16 and divides the downward flow of conditioned air through the discharge slot into a pair of discharge air streams 28, as represented by the arrows in FIG. 2.

With further reference to FIG. 2, it will be noted that the streams of discharged conditioned air from the terminal extend initially in a direction substantially parallel to the ceiling portions 24 adjacent to the air diffuser. It is here that the region of stagnation referred to above in the Description of the Prior Art, and as represented in FIG. 2 by the elliptically shaped arrangement of arrows 30, occurs and thus is the region where ceiling staining takes place.

Figure 3:
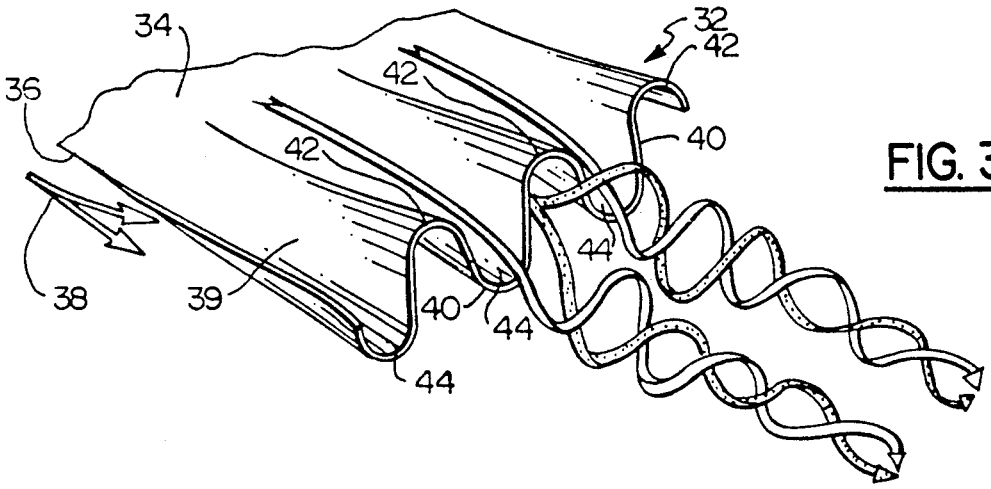
FIG. 3 is a perspective view of a convoluted surface for use in illustrating and describing the fluid dynamic mechanism made use of by the present invention.

Referring now to FIG. 3, a vortex generating wall 32 of the type disclosed in the above identified U.S. Pat. No. 4,815,531 is shown. The wall 32 has a top side or upper surface 34 and a lower side or bottom surface 36. Fluid flows over both of these surfaces in the same direction, which is the downstream direction as represented by the arrow 38. The downstream or trailing edge portion 39 of the plate is convoluted or wave-shaped. By this it is meant that each of the surfaces 34, 36 of the downstream portion 39 is comprised of a plurality of adjoining, alternating lobes 42 and troughs 44 which extend in the downstream direction to the downstream edge 40 of the vortex generating wall 32. As shown in the drawing, a lobe on one side of the wall has a corresponding trough on the opposite side of the wall. The lobes and troughs initiate upstream with essentially zero height or depth in the wall 32 and increase in depth and height to an appropriate size and shape at the downstream edge 40. The contour and dimensions of the troughs and lobes are selected to ensure that each trough flows full throughout its length. "Flows full" means that there is no streamwise two-dimensional boundary layer separation within the troughs.

The wave-shape of each surface 34, 36 results in the generation of vortices which rotate about an axis extending in the downstream direction.

In the '531 patent, the device described hereinabove is used to promote heat transfer to a flat surface downstream from the vortex generating wall 32. The bulk fluid flow in the '531 patent is the same on both the top and bottom walls 34, 36 of the vortex generating wall 32 and the vortices flowing from the top and bottom walls serve to combine with one another to promote such heat transfer.

Figure 4:
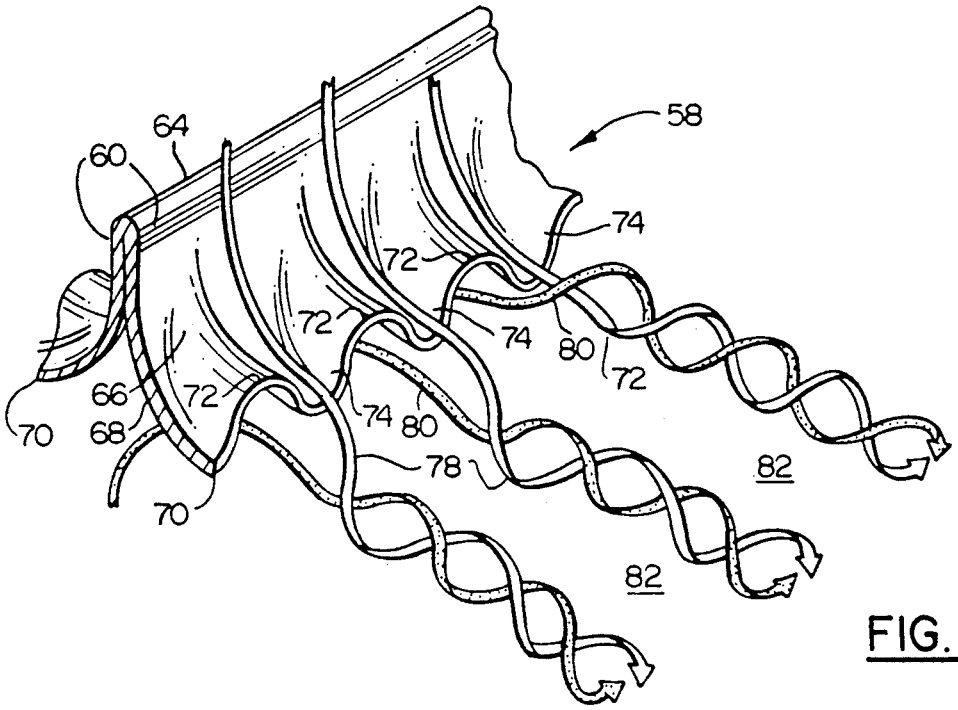
FIG. 4 is a perspective view of an air diffuser surface according to the present invention.
Figure 5:
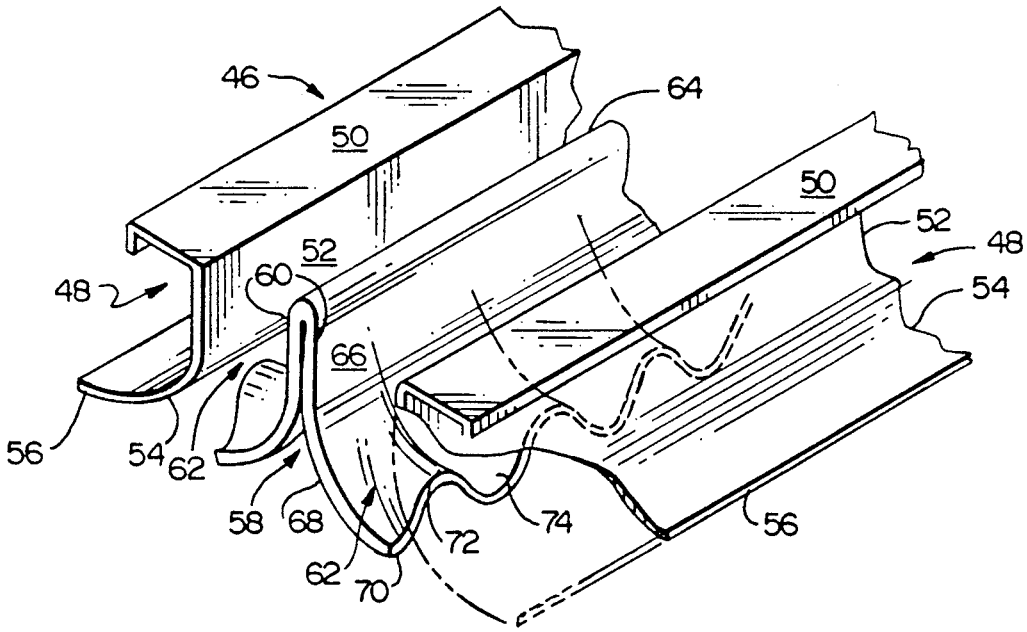
FIG. 5 is a perspective view of an air delivery device according to the principles of the present invention which makes use of the air diffusers surface of FIG. 4.

Referring now to FIGS. 4 and 5, an air discharge terminal having a diffuser according to the present invention is illustrated which is adapted to be installed in a ceiling application, as for example with the apparatus shown and discussed in connection with FIGS. 1 and 2. The diffuser 46 is defined by a pair of longitudinally extending parallel outlet members 48. Each of the outlet numbers 48 comprises a horizontally extending top flange 50 which facilitates attachment of the diffuser to an air terminal in a known manner. Each of the outlet members has a substantially vertical wall portion 52 extending downwardly from the horizontal member. Each of the vertical walls 52 makes a smooth transition to a curved, outwardly flared lower portion 54 each of which terminates in a substantially horizontally section 56 which is adapted to engage adjacent ceiling panels (not shown) in which the terminal is installed.

As shown in FIG. 5, positioned equidistantly between the pair of outlet members 48 is a vortex generating diffuser element 58. The vortex generating diffuser element 58 comprises two vortex generating wall sections 60 joined at the upper ends thereof at an apex 64 and which are mirror images of one another. Each of the vortex generating walls 60 cooperate with one of the outlet members 48, in a manner to be described below, to define an air discharge slot 62 therebetween.

Because of the symmetry of the structure about a vertical axis passing through the apex 64 of the vortex generating diffuser element, the description of the vortex generating walls 60 and their influence upon the conditioned air directed thereupon will be directed to one side only with the understanding that the other side is identical thereto. Further, to facilitate this description, the conditioned air directed into the diffuser 46 from the upper end thereof will be referred to as the bulk flow of conditioned air and the leading edge of the vortex generating walls 60 will be the portion of the wall originating at the apex 64 of the vortex generating diffuser element 58. From this, it follows that the downstream direction is downwardly and outwardly into the space into which the conditioned air is being delivered.

Each of the vortex generating walls 60 has a top side or upper surface 66 which is in fluid flow contact with the bulk flow of conditioned air through the diffuser. Likewise, each vortex generating wall 60 has a lower side or bottom surface 68 which is in fluid flow contact with the ambient air in the conditioned space. The downstream or trailing edge 70 of each of the walls 60 is convoluted or wave-shaped. By this it is meant that each of the surfaces 66 and 68 at the downstream edge 70 is comprised of a plurality of adjoining, alternating lobes 72 and troughs 74 which extend in the downstream direction to the downstream edge 70. As shown in the drawing, a lobe 72 on one side of the plate has a corresponding trough 74 on the opposite side of the plate. The lobes and troughs initiate at the upstream end, near the apex 64, of the element 58 with essentially zero height or depth in the wall 60 and increase in depth and height to an appropriate size and shape at the downstream edge 70. In addition to the contour of the troughs and lobes, each of the walls 60 follows a generally curved contour which is substantially parallel to the contour of the flared lower portion 54 of the outlet members 48 such that each of the vortex generating walls 60 defines, with one of the flared walls 54, the above noted air discharge slots 62 into which the bulk flow of conditioned air is received.

The lobes 72 and troughs 74 on the upper side of the wall 60 are configured such that they cooperate to direct the bulk flow of conditioned air thereupon into a plurality of fluid streams, each fluid stream is generally represented by a white ribbon designated by reference numeral 78 in FIG. 4. Each of the fluid streams 78 originates at the upstream end of one of the troughs 74 and gradually passes into the trough 74 during which time the flow of conditioned air within the trough develops a vortex flow of conditioned air which extends into the conditioned space downstream of the downstream edge 70 of the wall 60. Each of the individual vortices 78 of conditioned air extending from one of the troughs will then induce a secondary vortex flow, represented by a black ribbon and indicated by reference numerals 80, from the adjacent troughs on the lower side 68 of the wall 60 which is in fluid flow contact with the ambient air in the conditioned space. As a result, the vortices 78 flowing from the upper wall will produce a mixing flow field 83 downstream of the trailing edge 70 which comprises a plurality of vortices 78 of conditioned air intertwined with induced vortices 80 of ambient air drawn through the troughs on the lower side of the wall 60.

The mixing flow field 82 will promote rapid efficient mixing of the ambient air and the conditioned air being delivered into the conditioned space. Such mixing has particular advantage when the conditioned air being delivered is cold air in that the mixing results in the elimination of drafts and falling of cold air under the influence of gravity which often occurs when the air is not quickly and efficiently mixed upon introduction into the conditioned space.

A further advantage of the mixing flow field 82 is the action of the vortices, comprising the field, on the room ceiling adjacent the mixing flow field. Instead of the stagnation zone commonly caused by a linear flow of air being introduced into a room, the mixing flow field serves to scrub the ceiling in the region adjacent the mixing flow field and as a result serves to preclude the formation of ceiling stains adjacent the diffuser.

Figure 6:
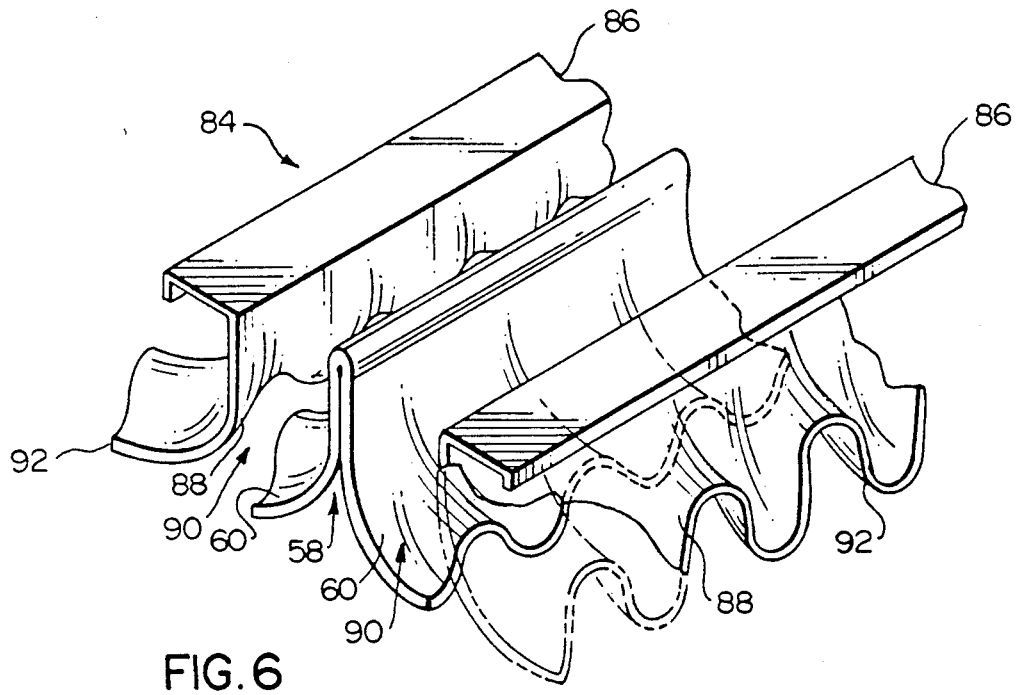
FIG. 6 is a perspective view of another embodiment of the present invention.

Looking now to FIG. 6 another horizontal slot type air diffuser 84 according to the principals of the present invention is illustrated. The diffuser 84 includes a centrally positioned vortex generating diffuser element 58 identical to that described in connection with the embodiment of FIGS. 4 and 5. In the diffuser 84 a pair of longitudinally extending, parallel outlet members 86 each includes a downwardly extending, outwardly curved, convoluted wave shape wall 88, each of which is substantially parallel to one of the vortex generating walls 60 of the central vortex generating diffuser element 58. Each of the walls 88 cooperates with one of the walls 60 to define an air discharge slot 90 therebetween. The lobes and troughs on the side of the wall 88 which face the air discharge slots are configured such that they also cooperate to direct the bulk flow of conditioned air directed thereupon into a plurality of fluid streams. Each of these fluid streams originates within a trough at the upstream end thereof and develops into a vortex flow of conditioned air which extends into the conditioned space downstream of the downstream edge 92 of the wall 88. The vortices generated by the walls 88 pass into the mixing flow field 82 downstream of the trailing edge of the wall 60 to further promote the mixing and scrubbing action of the conditioned air passing into the conditioned space.

Figure 7:
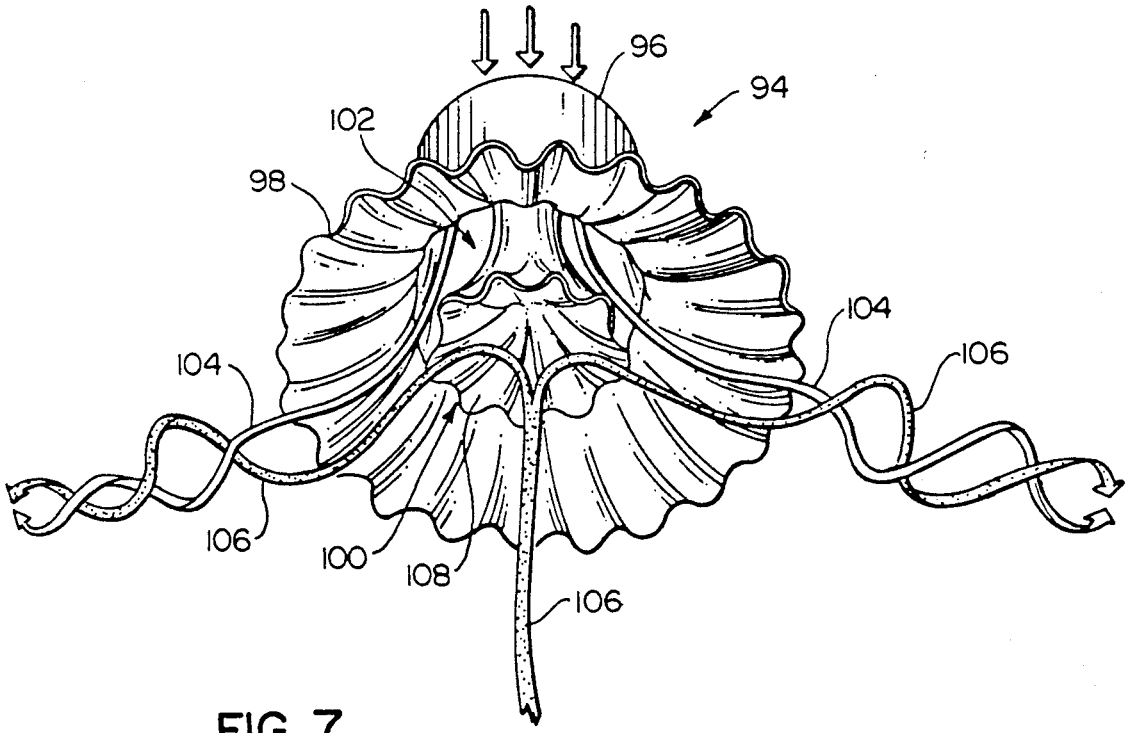
FIG. 7 is a perspective view of yet another embodiment according to the principles of the present invention.

FIG. 7 illustrates the principals of the present invention as applied to a circular air diffuser 94 of the type configured to be mounted in a ceiling with its upper or smaller end 96 designed to be connected to an air supply duct for the flow of conditioned air downwardly and outwardly therefrom. The diffuser 94 comprises an outer, outwardly flared, convoluted wall 98 containing troughs and lobes therein and which is analogous to the walls 88 of the embodiment illustrated in FIG. 6. Disposed concentrically within the outer wall 98 is an inner vortex generating diffuser element 100 which is analogous to the centrally mounted vortex generating diffuser element 58 of both of the previously described embodiments. The outer flared wall 98 and the inner vortex generating element 100 cooperate to define an annular air discharge slot 102 there between. This slot 102 is analogous to the longitudinally extending slots 90 of FIG. 6 and the flow of conditioned air upon the surfaces of these walls and the development of vortices from the trailing edges of these walls follows the same fluid flow dynamic principals as described hereinabove For purposes of illustration only several vortices of conditioned air are identified in FIG. 7 by reference numberal 104. Also shown in FIG. 7 are several representative induced streams of ambient air, identified by reference numeral 106 and which originate on the lower surface 108 of the centrally disposed vortex generating diffuser element 100 of the circular diffuser 94.

Accordingly it should be appreciated that, an air diffuser geometry has been provided which is capable of producing a mixing flow field downstream of the outlet of the air diffuser. The mixing flow field comprises a plurality of vortices of conditioned air intertwined with induced vortices of air from the space being ventilated.

This invention may be practiced or embodied in still other ways without departing from the spirit or essential character thereof. The preferred embodiments described herein are therefore illustrative and not restrictive, the scope of the invention being indicated by the appended claims and all variations which come within the meaning of the claims are intended to be embraced therein.

What is claimed is:

1. An air diffuser for receiving a bulk flow of conditioned air at the upstream end thereof and for directing the air from the downstream end thereof into a conditioned space, comprising:

a pair of spaced parallel walls, cooperating with one another to form an air discharge slot, at least one of said walls having a first side in fluid flow contact with the bulk flow of conditioned air and the second side thereof in fluid flow contact with the ambient air in the conditioned space;

said one wall having an exposed downstream edge such that conditioned air and ambient air flowing, respectively, over said first and second sides thereof will mix together in the conditioned space downstream from said edge;

said one wall comprising: a plurality of adjoining, alternating lobes and troughs, each lobe and trough extending in the downstream direction to said downstream edge, said troughs increasing in depth in the downstream direction from a minimum at said trough's upstream ends, each lobe on one side of said wall having a corresponding trough opposite thereto on the other side of said wall such that said wall and said downstream edge are wave shaped, said lobes and troughs being configured such that they cooperate to direct the bulk flow of conditioned air on said first side thereof into a plurality of fluid streams, each of said fluid streams originating at the upstream end of one of said troughs and gradually passing into said trough wherein the flow of conditioned air within said trough develops a vortex flow of conditioned air which extends downstream of said downstream edge of said wall, each of said vortices of conditioned air extending from a trough on said first side of said wall inducing a secondary vortex flow from the adjacent troughs on the second side of said wall within the conditioned space to thereby produce a mixing flow field downstream of said downstream edge comprising a plurality of vortices of conditioned air intertwined with induced vortices of ambient air drawn through the troughs on the second side of said wall.

2. The apparatus of claim 1 wherein said pair of spaced parallel walls and the air discharge slot defined therebetween are curved in the direction from said upstream end of said air diffuser to said downstream end of said air diffuser to thereby change the direction of conditioned air flow as it passes through said air discharge slot from said upstream end to said downstream end.

3. The apparatus of claim 2 wherein the other of said pair of spaced parallel walls has a geometry configured substantially the same as said one wall.

4. The apparatus of claim 1 wherein each of said pair of spaced parallel walls extends longitudinally in a direction perpendicular to the flow of conditioned air through said diffuser, to define a longitudinally extending air discharge slot.

5. The apparatus of claim 1 wherein each of said spaced parallel walls comprises a circular closed wall to thereby define an annular air discharge slot there between.

6. The apparatus of claim 2 wherein each of said pair of spaced parallel walls extends longitudinally in a direction perpendicular to the flow of conditioned air through said diffuser, to define a longitudinally extending air discharge slot.

7. The apparatus of claim 6 further including a second pair of spaced parallel walls, said second pair of walls being substantially identical to said first pair of spaced parallel walls and being positioned adjacent to and in mirror image relationship, to said first pair of spaced parallel walls to define a second air discharge slot extending in substantially the opposite direction to said air discharge slot of said first pair of spaced parallel walls.

* * * * *